US010626793B2

(12) United States Patent
Radocaj

(10) Patent No.: US 10,626,793 B2
(45) Date of Patent: Apr. 21, 2020

(54) INTERNAL PRESSURE DRIVEN ENGINE

(76) Inventor: Mijo Radocaj, Massillon, OH (US)

( * ) Notice: Subject to any disclaimer, the term of this patent is extended or adjusted under 35 U.S.C. 154(b) by 873 days.

(21) Appl. No.: 12/645,986

(22) Filed: Dec. 23, 2009

(65) Prior Publication Data

US 2011/0146629 A1 Jun. 23, 2011

(51) Int. Cl.

| | |
|---|---|
| ***F02B 75/28*** | (2006.01) |
| ***F02N 11/00*** | (2006.01) |
| ***F02N 5/04*** | (2006.01) |
| ***F02N 15/02*** | (2006.01) |

(52) U.S. Cl.

CPC ..... *F02B 75/282* (2013.01); *F02N 5/04* (2013.01); *F02N 11/00* (2013.01); *F02N 15/02* (2013.01)

(58) Field of Classification Search

USPC ..... 123/51 R, 179.25, 185.14

See application file for complete search history.

(56) References Cited

U.S. PATENT DOCUMENTS 4,312,306 A * 1/1982 Bundrick, Jr. ..... 123/51 BA
4,535,730 A * 8/1985 Allen ..... F02B 75/048 123/48 B
2008/0163842 A1* 7/2008 Forssell et al. ..... 123/179.25
2008/0178835 A1* 7/2008 Nelson ..... 123/197.5

* cited by examiner

*Primary Examiner* — Stephen K Cronin
*Assistant Examiner* — Ruben Picon-Feliciano
(74) *Attorney, Agent, or Firm* — Renner, Kenner, Greive, Bobak, Taylor & Weber Co., L.P.A.

(57) ABSTRACT

An internal combustion engine or other internal pressure driven engine of the type capable of converting reciprocal linear powered motion into unidirectional rotary motion, the engine having at least one pair of first and second cylinders with each cylinder having a pair of opposed pistons therein forming a pressure chamber therebetween. Outer ends of each piston carries a piston rod connected to a pivot arm of a respective one way clutch which causes the clutch to oscillate back and forth when the piston moves in and out due to pressure or combustion in the pressure chamber. Alternatively, the piston rods may be configured as gear racks in direct operative engagement with pinion gears of the one way clutches. The clutches are parallel and spaced apart from each other near each end of the cylinders. Each clutch carries a gear on one end which intermeshes with a gear rack assembly having gears and a gear rack which drives a crankshaft and auxiliary flywheel operatively connected to a starter. Once the starter is turned on the kinetic energy of the flywheel and gear rack keeps the on/off clutches in continuous oscillation. The oscillating clutches turn unidirectional drive shafts connected through pinion gears to a main output shaft and main flywheel.

20 Claims, 13 Drawing Sheets

INTERNAL PRESSURE DRIVEN ENGINE

FIELD OF THE INVENTION

This invention relates to an internal pressure driven engine for converting reciprocal linear motion of a pair of opposed pistons in each cylinder into unidirectional rotary motion acting on an output shaft. The term internal pressure driven engines can include internal combustion engines, diesel engines, steam engines or fluid pressure driven engines.

BACKGROUND OF THE INVENTION

It is known to use a pair of opposed pistons in each cylinder of an internal combustion engine and to convert the linear reciprocating motion of the pistons into a rotary motion of a drive shaft.

Such an engine having opposed pistons in each cylinder operating a crank shaft on opposite ends of the cylinder is shown in U.S. Pat. No. 876,870 (Gordon).

It is also known to use a pair of opposed pistons in each cylinder operating through a rack and pinion gear to convert the reciprocating movement to rotary motion and shown in U.S. Pat. No. 2,079,289 (Janicke) and U.S. Pat. No. 3,384,057 (Boone).

ASPECTS OF THE INVENTION

It is an aspect of the invention to increase the power of the engine by linking each piston rod of the pistons to a respective pivot arm of a one way clutch mechanism to cause reciprocating movement of each clutch mechanism and each clutch mechanism being operatively connected through a gear and rack to a crankshaft mechanism with an auxiliary flywheel to provide continuous rotational movement of an output shaft operatively connected to each clutch. The invention contemplates piston power transmission to the clutch mechanisms through pivoting arms and piston rods in one instance, and pinion gears driven by piston rods configured as gear racks in another—the latter providing increased efficiency over the former.

SUMMARY OF THE INVENTION

An internal pressure driven engine of the type capable of converting reciprocal linear powered motion into unidirectional rotary motion for acting on an output drive, comprising: an engine block having at least one pair of first and second cylinders with each cylinder having an annular interior cylinder wall; a pair of opposed pistons within each cylinder, each piston having an inwardly facing end and an outwardly facing end; the pistons and the cylinder wall forming a pressure chamber between inwardly facing ends of the pistons; means creating pressure within the pressure chamber to cause both pistons to move axially in a reciprocating movement to and from each other; a piston rod pivotally attached to the outer end of each piston and extending axially outwardly from the outer end of the cylinder; each piston rod having an outer end pivotally connected to a pivot arm on a respective one way clutch to cause reciprocal rotation of the one way clutch with the clutch and pivot arm reversing direction of rotation with each outward and inward stroke of the piston; each first and second cylinder of the pair being parallel to each other and spaced apart a sufficient distance from each other so that the end of a piston rod extending from one end of the first cylinder is pivotally connected to a first pivot arm on an adjacent first one way clutch and the end of the piston rod extending from an adjacent end of the second cylinder is pivotally connected to a second pivot arm on the adjacent first one way clutch with one of the piston rods moving in an outward stroke while the other is moving in an inward stroke; the piston rods extending from opposite ends of the first and second cylinders being pivotally connected to pivot arms on a second one way clutch to cause it to simultaneously rotate in a direction opposite to the first one way clutch and both the first and second pivot arm each connected through a clutch mechanism to an output shaft and drive gear with the clutch alternating between engage and disengage position to convert the reciprocating movement of the first and second pivot arm to continuous unidirectional rotation.

DETAILED DESCRIPTION OF THE INVENTION

Figure 1:
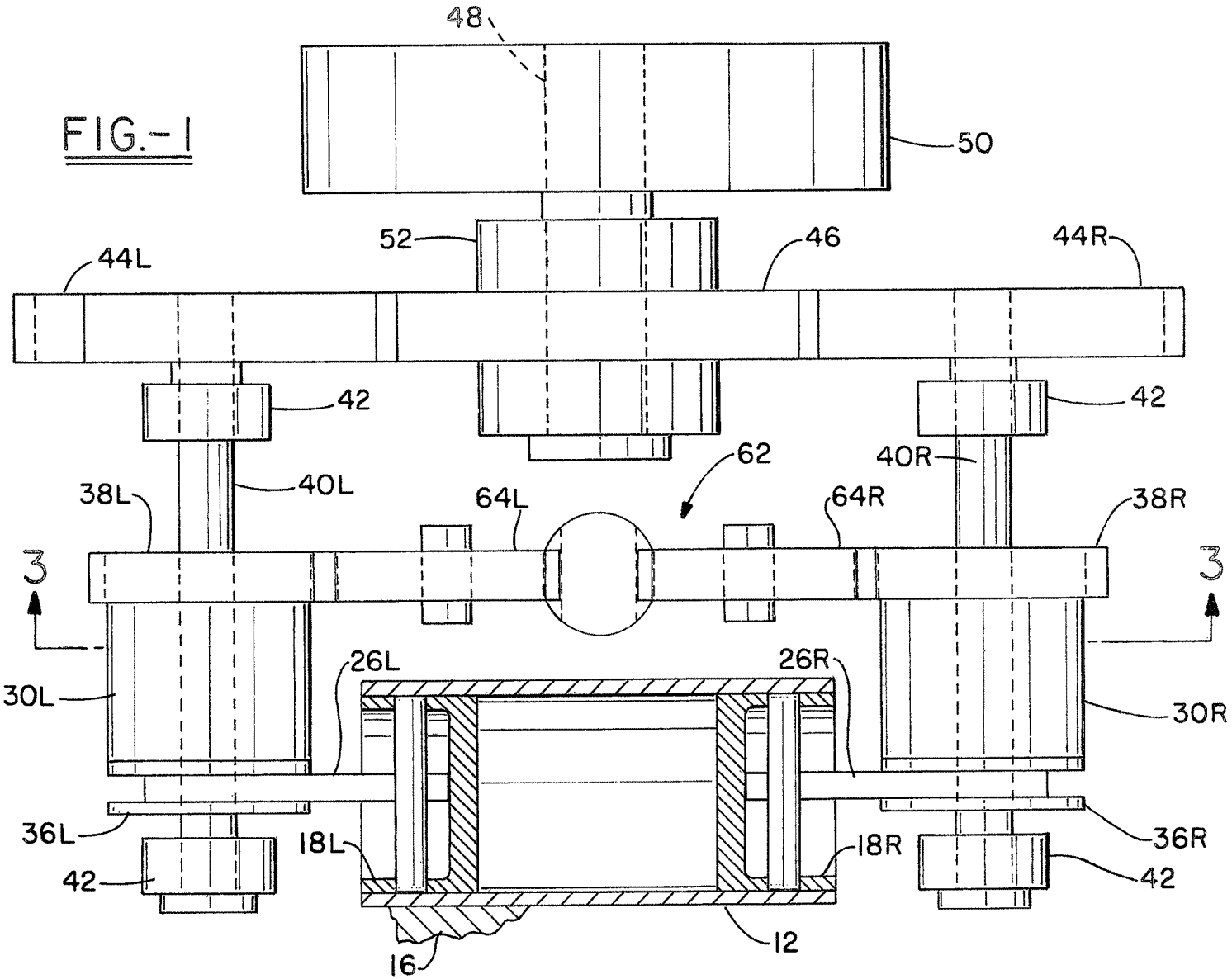
FIG. 1 is a top plan view of one embodiment of the invention.

Referring now to the drawings and in particular to FIGS. 1-4, the internal pressure driven engine is indicated as a whole by the numeral 10. The engine 10 has an upper cylinder 12 and a lower cylinder 14 in an engine block 16.

For simplifying the drawings, the detailed shape of the engine block 16 will not be shown since the block may be of any shape needed to contain the various engine components which will later be described herein. The drawings will show the various components of the engine in their relative locations with respect to each other and how they are operatively interconnected with each other. It will be understood that suitable openings in the engine block will be provided for mounting bearings, gears, clutches and various other components of the engine.

The engine 10 shown in FIGS. 1-4 will be described as an internal combustion engine, however the overall arrangement of the working parts of this engine could apply equally to diesel engines, steam engines or other types of fluid pressure driven engines.

The cylinders 12 and 14 can be bored in the engine block 16 or made as separate parts and fastened to the block. The cylinders may contain conventional spark plugs, intake and exhaust ports or valves (not shown for simplicity).

The upper cylinder 12 has opposed pistons 18L and 18R therein with a combustion or pressure chamber 20 therebetween and the lower cylinder 14 has opposed pistons 22L and 22R with combustion or pressure chamber 24 therebetween.

Figure 2:
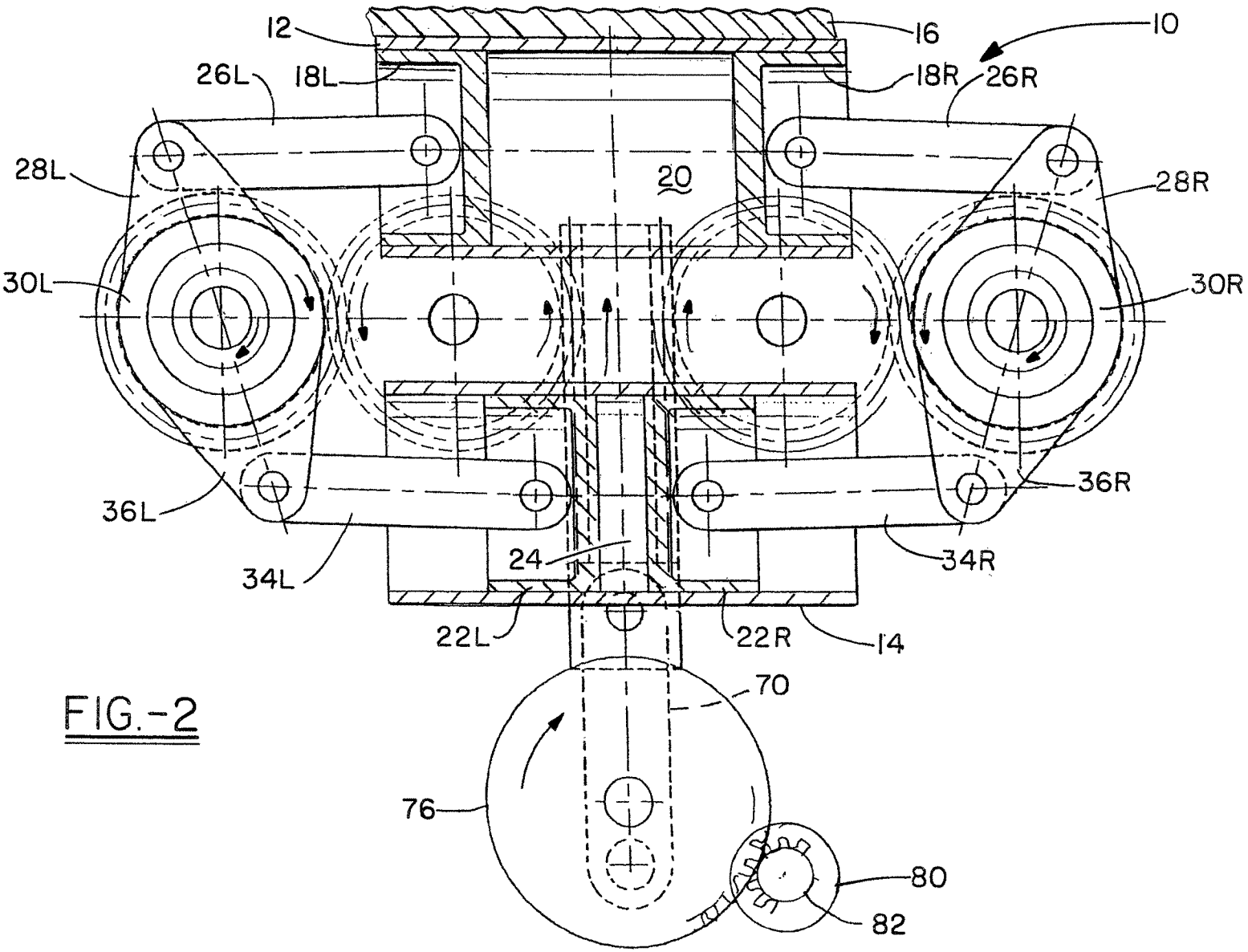
FIG. 2 is a side elevational view of the invention.
Figure 5:
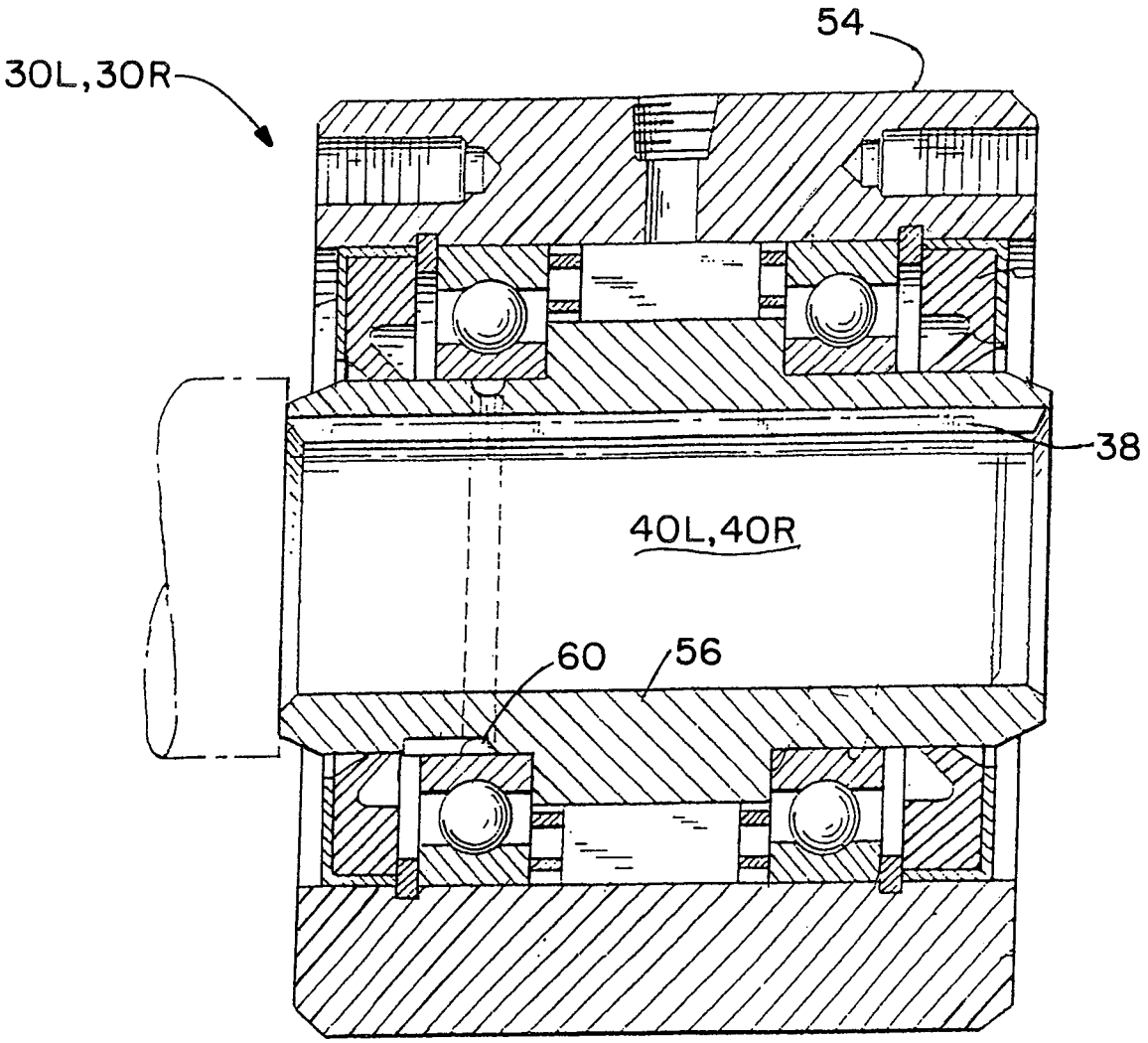
FIG. 5 is a cross sectional view through one of the one way clutches used in the invention.

The pistons 18L and 18R have respective piston rods 26L and 26R pivotally connected to the outer ends thereof and extending axially outwardly therefrom, the outer ends of the piston rods 26L and 26R being respectively connected to pivot arms 28L and 28R, which are respectively connected to clutches 30L and 30R to cause the clutches to rotate a predetermined distance in a reciprocating motion as the pistons move inwardly and outwardly within the cylinder 12. As shown in FIG. 2, that predetermined distance is established by the angular displacements of the pivot arms 28, 36 when the associated pistons 18, 22 move between maximum and minimum separation during the combustion cycles. The clutches 30L and 30R are conventional commercially available cam clutches such as shown in FIG. 5, which will be described in further detail later.

Likewise the pistons 22L and 22R have respective piston rods 34L and 34R pivotally connected to the outer ends thereof and extending axially outwardly therefrom, the outer ends of the piston rods 34L and 34R being respectively connected to pivot arms 36L and 36R which are respectively connected to the clutches 30L and 30R to cause the clutches to rotate back and forth a predetermined distance in a reciprocating motion as the pistons move inwardly and outwardly within the cylinder 14.

It may be seen in FIG. 2 that pivot arms 28L and 36L extend in opposite directions from each other and pivot arms 28R and 36R also extend in opposite directions so that when the pistons 18L and 18R are moving axially outwardly due to combustion, the pistons 22L and 22R are moving axially inwardly producing compression within the cylinder 14. The range of movement of pivot arms 28, 36 through an entire combustion cycle and the resulting angular range of movement of the associated clutches 30 is extremely small, as shown in FIG. 2. Accordingly, the effective torque arm length of the pivot arm 28, 36 is substantially constant. Those skilled in the art will appreciate that the smaller the arc of movement of the pivot arms 28, 36, the smaller the deviation of the effective torque arm length of the pivot arms 28, 36 from constant. With further reference to FIG. 2, the skilled artisan will readily appreciate that the effective torque arm length correlates directly with the physical length of the pivot arms 28, 36, which correlates directly with the distance of separation between the cylinders 20, 24, respectively receiving pistons 18, 22 and associated piston rods 26, 34.

Referring now to FIG. 1, the clutch 30L has a gear 38L attached to the opposite end from the pivot arm 36L to move back and forth with the reciprocating movement of the clutch 30L. Similarly the clutch 30R has a gear 38R attached to the opposite end from the pivot arm 36R to move back and forth with the reciprocating movement of the clutch 30R. Extending from each end of clutches 30L and 30R are center shafts 40L and 40R which are operatively connected to the clutches 30L and 30R in such manner as to rotate continuously in one direction regardless of the back and forth reciprocal motion of the clutches. The shafts 40L and 40R have respective bearings 42 on each end thereof. The shafts 40L and 40R respectively have gears 44L and 44R affixed to one end thereof and intermeshing with a main drive gear 46 which is connected to a drive shaft 48 on which is mounted a flywheel 50. The gear 46 and shaft 48 are mounted in a suitable bearing 52.

The clutches 30L and 30R are both of the type shown in cross section in FIG. 5 and are commercially available Morse cam clutches of the type shown in U.S. Pat. No. 3,542,442 (Kent) which is incorporated herein in its entirety for the purposes of reference to the detailed working of the clutch. As shown in FIG. 5, the clutches 30L and 30R have an outer race 54 and an inner race 56 secured to shaft 40L or 40R by a key 58 to cause the inner race 56 and shaft to rotate together. A pair of bearings 60 are located between the inner and outer race.

When the clutch is engaged, the outer race 54, the inner race 56 and the shaft 40L or 40R rotate together in the same direction. When the clutch is disengaged the outer race 54 rotates in the opposite direction as the inner race 56 and shaft 40L or 40R. The timing of engage and disengage of the clutches is such that the clutch is engaged when the outer race 54 is moving in one direction but is disengaged when the outer race 54 is moving in the opposite direction. Thus it can be seen the inner race 56 and the shafts 40L and 40R are moved only in one direction by step by step intermittent engagement with the outer race 54 but the inner race 56 and shafts 40L and 40R rotate continuously in one direction by forward momentum as will be explained.

Figure 3:
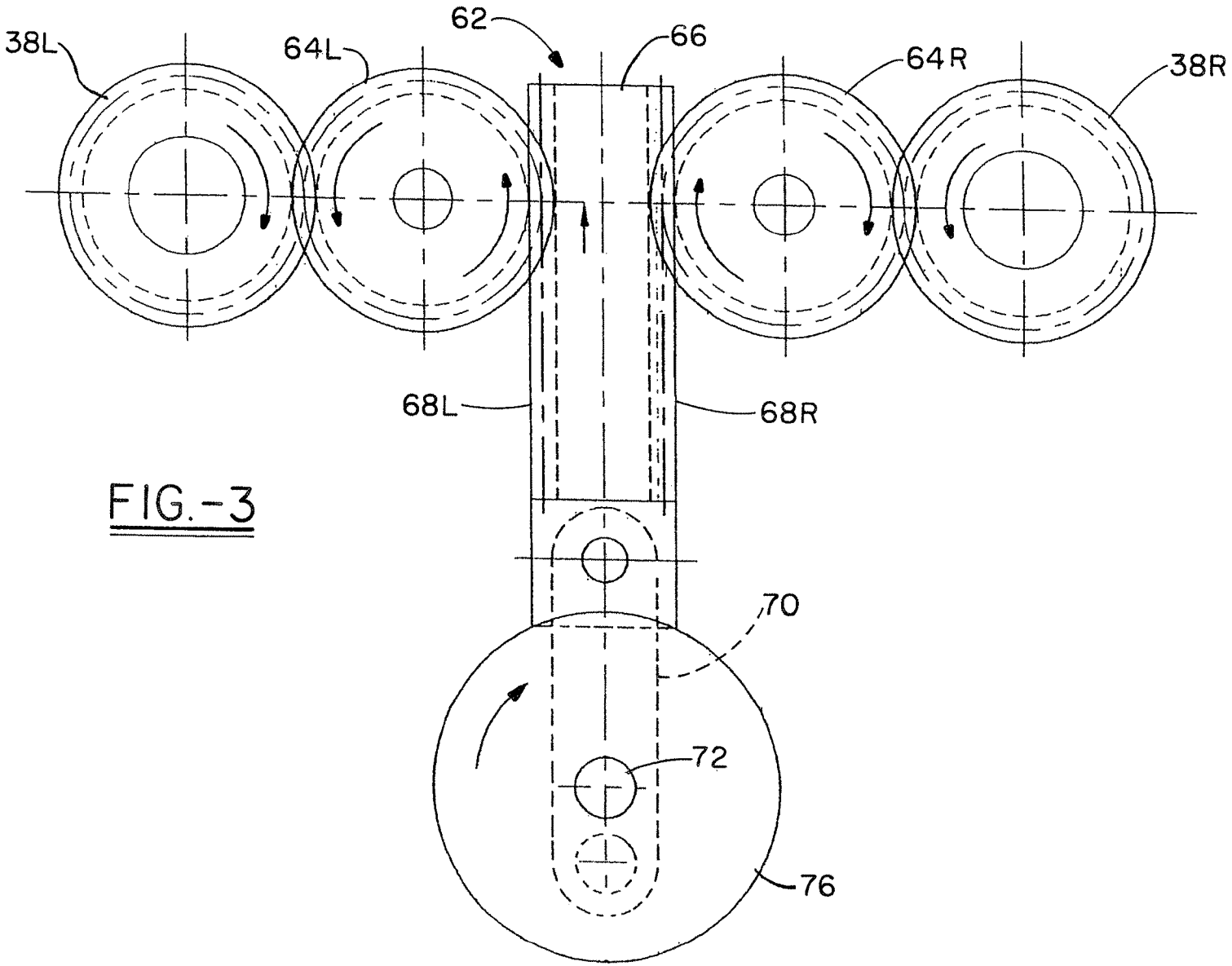
FIG. 3 is a cross section view of the invention taken on line 3-3 of FIG. 1.

In order to start the engine and provide continuous unidirectional rotation of the shafts 40L and 40R a gear and gear rack assembly 62 intermeshes with gears 38L and 38R as will be further described with respect to FIGS. 1 and 3.

Figure 4:
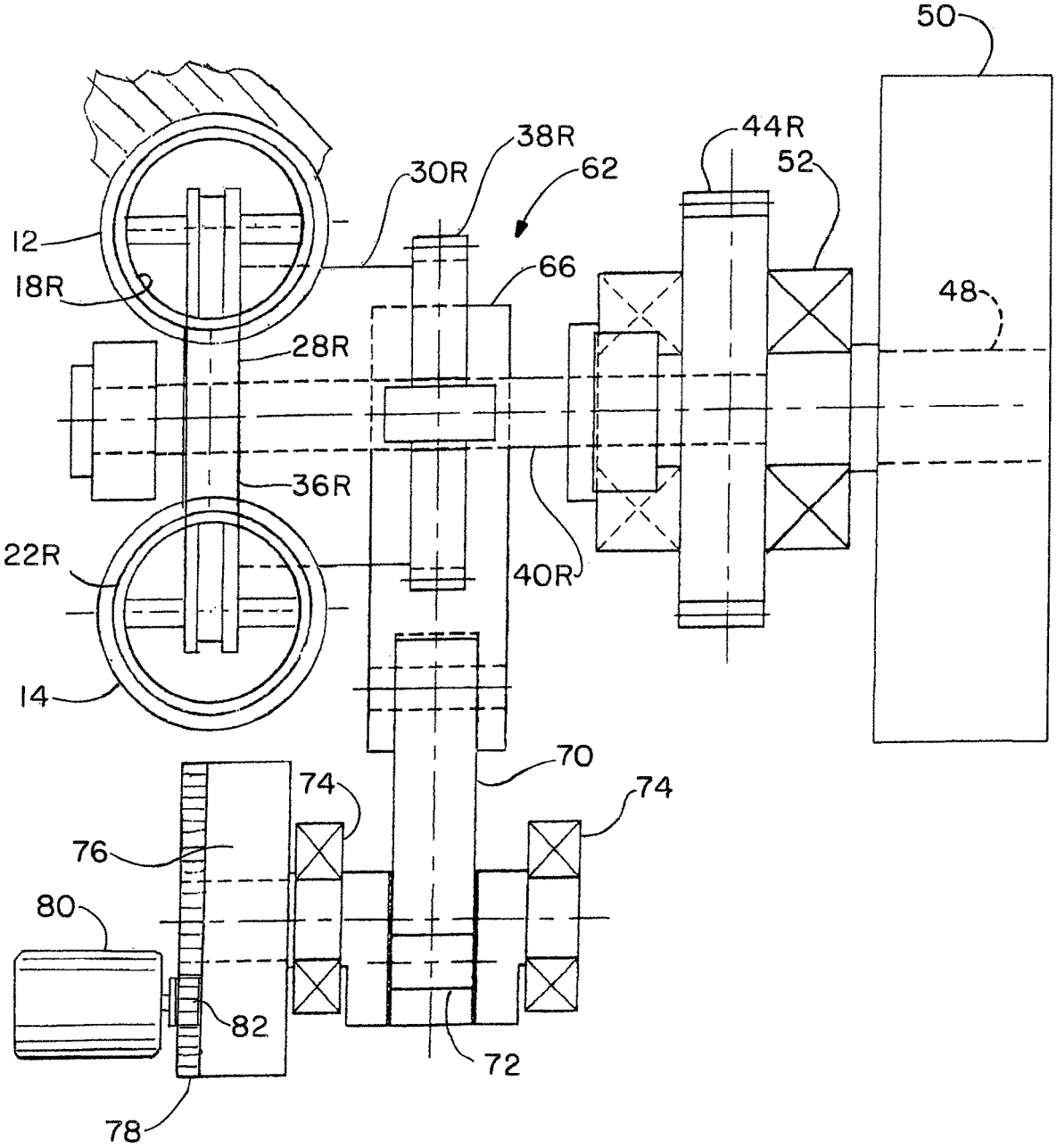
FIG. 4 is an end elevational view of the invention looking toward the right end of FIG. 2.

Referring now to FIGS. 1, 3 and 4, the gear rack assembly 62 has a pair of intermediate gears 64L and 64R which respectively intermesh with gears 38L and 38R and with teeth 68L and 68R on a vertical gear rack 66. The gear rack 66 is pivotally connected to a connecting rod 70 which in turn is connected to a crankshaft 72 mounted in bearings 74. The crankshaft 72 carries an auxiliary flywheel 76 on one end thereof. The auxiliary flywheel 76 has a ring gear 78 around its periphery. An electric starter 80 has a driving gear 82 which intermeshes with the ring gear 78. When the starter 80 is turned on, the driving gear 82 rotates and causes rotation of the ring gear 78 and thereby causes the auxiliary flywheel 76 to rotate along with the crankshaft 72. This combination of rotation and oscillation causes the gear rack 66 to move up and down and rotate intermediate gears 64L and 64R, as well as gears 38L and 38R, one way clutches 30L and 30R, pivot arms 28L and 28R and pivot arms 36L and 36R with piston rods 26L, 26R, 34L, 34R moving with pistons 18L, 18R, 22L and 22R. This movement of the above described parts activates intermittent combustion or pressurization within the cylinders 12 and 14 along with the intermittent engagement and disengagement of the clutches 30L and 30R.

After combustions in cylinders 12 and 14, the starter 82 stops and gears 82 and 78 disengage. The engine 10 continues to rotate due to stored kinetic energy in the flywheel 76 and combustion or injection of pressure continues in cylinders 12 and 14. Combustion in cylinders 12 and 14 creates pressure which is applied to the inner ends of the pistons. The pistons 18L and 18R are driven outwardly with equal pressure force and simultaneously pistons 22L and 22R are driven inwardly.

When the piston 18L is pressure driven outwardly, it drives connecting rod 26L which drives pivot arm 28L and engaged one way clutch 30L which is transmitting torque onto shaft 40L. At the same time piston 18R is driven with equal pressure force as is piston 18L. Piston 18R drives connecting rod 26R which drives pivot arm 28R and disengaged one way clutch 30R and pinion gear 38R. Pinion gear 38R drives pinion gear 64R which drives gear rack 66, connecting rod 70, crankshaft 72 and flywheel 76. As gears 38L and 38R mounted on clutches 30L and 30R are caused to intermittently rotate back and forth in an oscillating motion, they in turn, transfer the same oscillation motion to the intermediate gears 64L and 64R which causes the gear rack 66 to move up and down causing continuous movement of the connecting rod 70, rotation of the crankshaft 72 and the flywheel 76.

The clutches 30L and 30R are timed so that when one is engaged the other is disengaged. The intermeshing of the gears of the gear and rack assembly 62 is such that even though only one of the one way clutches 30L or 30R is transmitting rotational force at any one time, this force is transferred through the gears of the assembly and the gear rack 66 to the opposite gear. Once the crankshaft 72 and the flywheel 76 are set in motion, the momentum or kinetic energy of the rotating flywheel 76 causes continuous rotational force to be transferred as continuous oscillating force to the one way clutches 30L and 30R which covert the oscillating motion to continuous rotation of the shafts 40L and 40R, gears 44L, 44R and 46 and ultimately the main drive shaft 48 and the main flywheel 50.

Thus it may be seen that the gear rack assembly 62 serves not only to transfer the rotational force of the starter to the clutches 30L and 30R, but it also operatively interconnects the movement of the piston rods 26L and 34L with piston rods 26R and 34R to assure continuous oscillating movement of the clutches 30L and 30R due to the continuous rotation of the auxiliary flywheel 76.

As apparent from FIGS. 1-4, and particularly FIG. 2, it will be appreciated that the pistons 18L and 18R of cylinder 12 are at their most extended or separated positions at the end of their power stroke, while the pistons 22L, 22R of cylinder 14 are at their most adjacent positions at the end of their compression stroke. The small arcs of operation of the pivot arms 36L and 36R and 28L and 28R as they reciprocate is apparent from FIG. 2 as is the limited movement of the piston rods 26L, 26R, 34L, 34R, which causes the associated torque arms to be of a substantially constant length. The step-by-step intermittent engagements of the one-way clutches 30L, 30R are a result of their timed operation so that when one is engaged, the other is disengaged.

It will also be appreciated by those skilled in the art that the operation of the system shown in FIG. 2 is characterized by an effective torque arm length associated with each piston 18, 22 and its cylinder 12, 14 as a function of the length of the pivot arms 28, 36. Hence, separating the parallel cylinders 12, 14 further apart, with the necessary extension of the pivot arms 28, 36, necessarily increases the associated effective torque arm lengths, while increasing the stroke length of the pistons 18, 22 insubstantially impacts the effective torque arm length, because of the small arcs of operation of the pivot arms as described above.

While for the purpose of simplicity the main description of the operation of the engine deals with the embodiment shown in FIGS. 1-4 wherein one pair of cylinders are shown, it should be understood that any number of pairs of cylinders can be used and interconnected with the gear and rack assembly.

Figure 6:
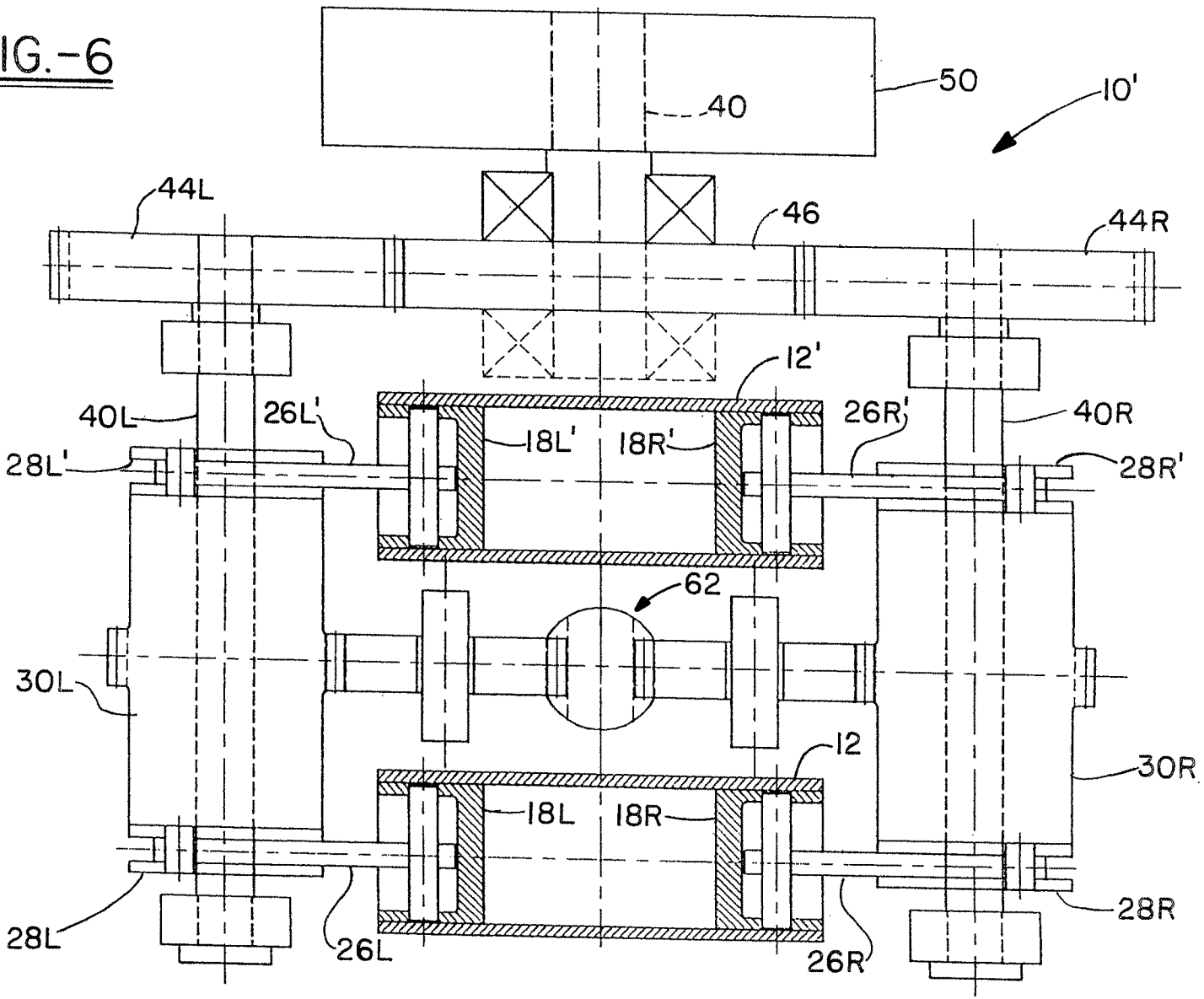
FIG. 6 is a top plan view of another embodiment of the invention similar to FIG. 1 but having two pairs of cylinders.
Figure 7:
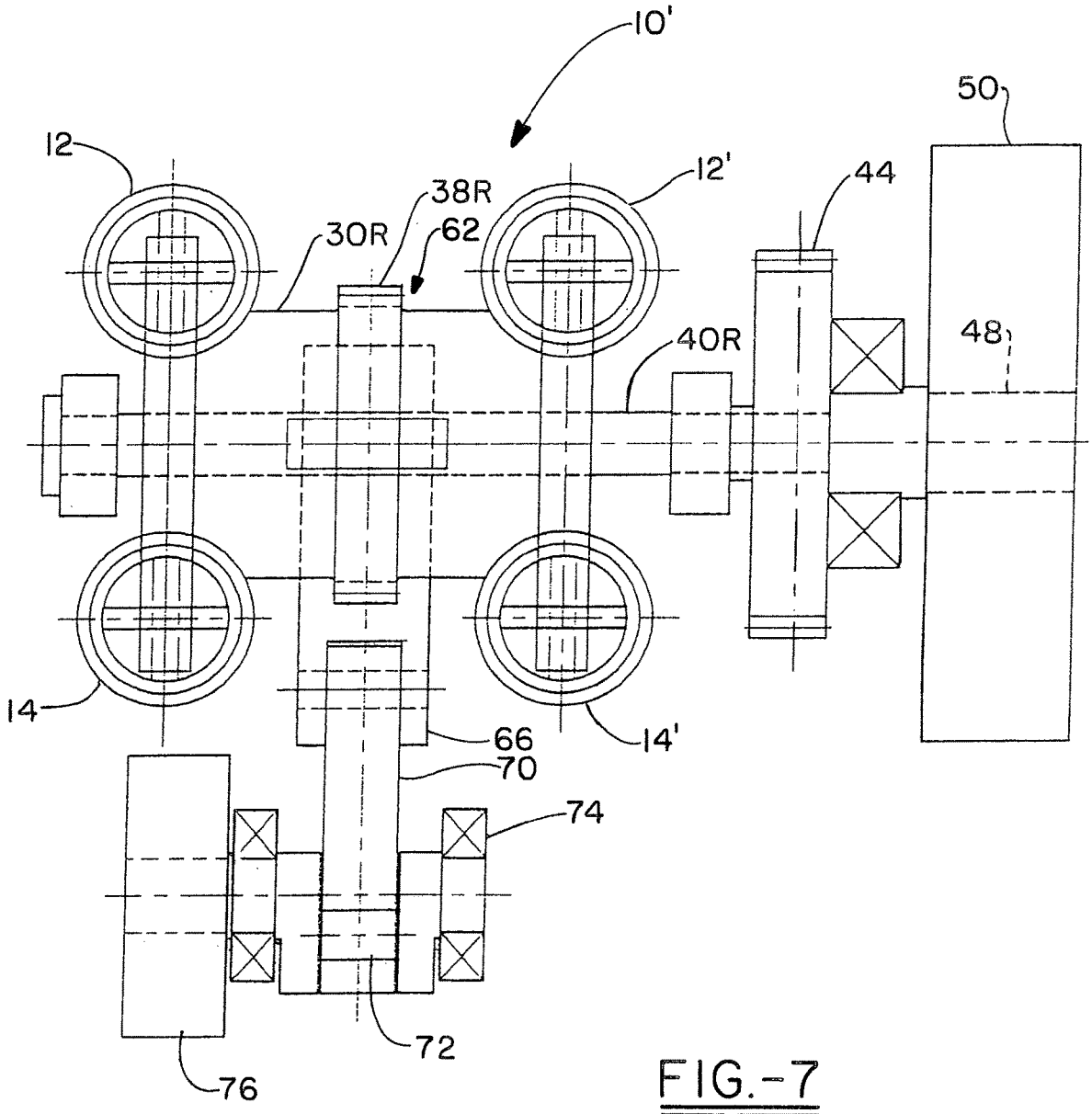
FIG. 7 is an end elevational view of the embodiment of the invention shown in FIG. 6 and having two pairs of cylinders.

Another embodiment of the invention is shown in FIGS. 6 and 7, which is similar in most respects to that shown in FIGS. 1-4 except that it uses two pairs of cylinders instead of one. In this embodiment the engine is identified by the numeral 10'. The parts of engine 10' that are identical to engine 10 will bear identical numerals to those in FIGS. 1-4 except that the parts associated with the second pair of pistons will be identified with numerals bearing a prime (').

Cylinders 12' and 14' are mounted adjacent the opposite ends of clutches 30L and 30R from the cylinders 12 and 14. Cylinder 12' contains opposed pistons 18L' and 18R' respectively connected to piston rods 26L' and 26R' which in turn are connected to pivot arms 28L' and 28R' mounted one end of clutches 30L and 30R. Cylinder 14' contains a pair of opposed pistons, connected to piston rods and pivot arms similar to those associated with cylinder 12' but are not show for the purpose of simplicity. The interaction between the parts associated with cylinders 12' and 14' are similar to those of cylinders 12 and 14 shown in FIG. 2.

In FIG. 6 it may be seen that the parts associated with cylinder 12 and 12' are connected to opposite ends of the clutches 30L and 30R. The pistons in both cylinders 12 and 12' are both shown as in the same position within their respective cylinders. This is necessary since they are connected to the same clutch and move with the clutch as it oscillates back and forth as described with regard to the embodiment in FIGS. 1-4.

It is also possible that the pistons and piston rods could be connected to two separate clutches instead of a single clutch. In such instance, the pistons need not be moving together in the same respective position within the cylinder. For example one set of pistons could be in the retracted position while the other set of pistons would be in the extended position.

As shown in FIGS. 6 and 7, when both pairs of pistons are connected to the same clutch only one gear and rack assembly 62 is needed. If each pair of pistons is connected to two separate clutches, there will need to be a separate gear and rack assembly for each clutch. The operation of the engine 10' is basically the same as engine 10 and will not be described in further detail. No side elevational view is shown of the embodiment shown in FIGS. 6 and 7 since it is identical to the view shown in FIG. 2. The cross section view in FIG. 3 showing the gear and rack assembly 62 applies to both the engine 10 and 10'.

It will be appreciated that the embodiments of the invention presented and described above typically employ pivot arms 28, 36 respectively connected to piston rods 26, 34 for transferring the piston force through a gear chain to an output. While the embodiments presented and described are efficient and effective for their intended purpose, the implementation of pivot arms interconnected with piston rods, which are themselves pivotally connected to the associated pistons, result in a torque arm that changes with translational movement. As a result, the output force varies accordingly. While the losses associated with this pivotal action are somewhat minimal, it is most desirable to provide power transmission from the pistons through a torque arm that is constant. Such an embodiment is shown in FIGS. 8-10.

Figure 8:
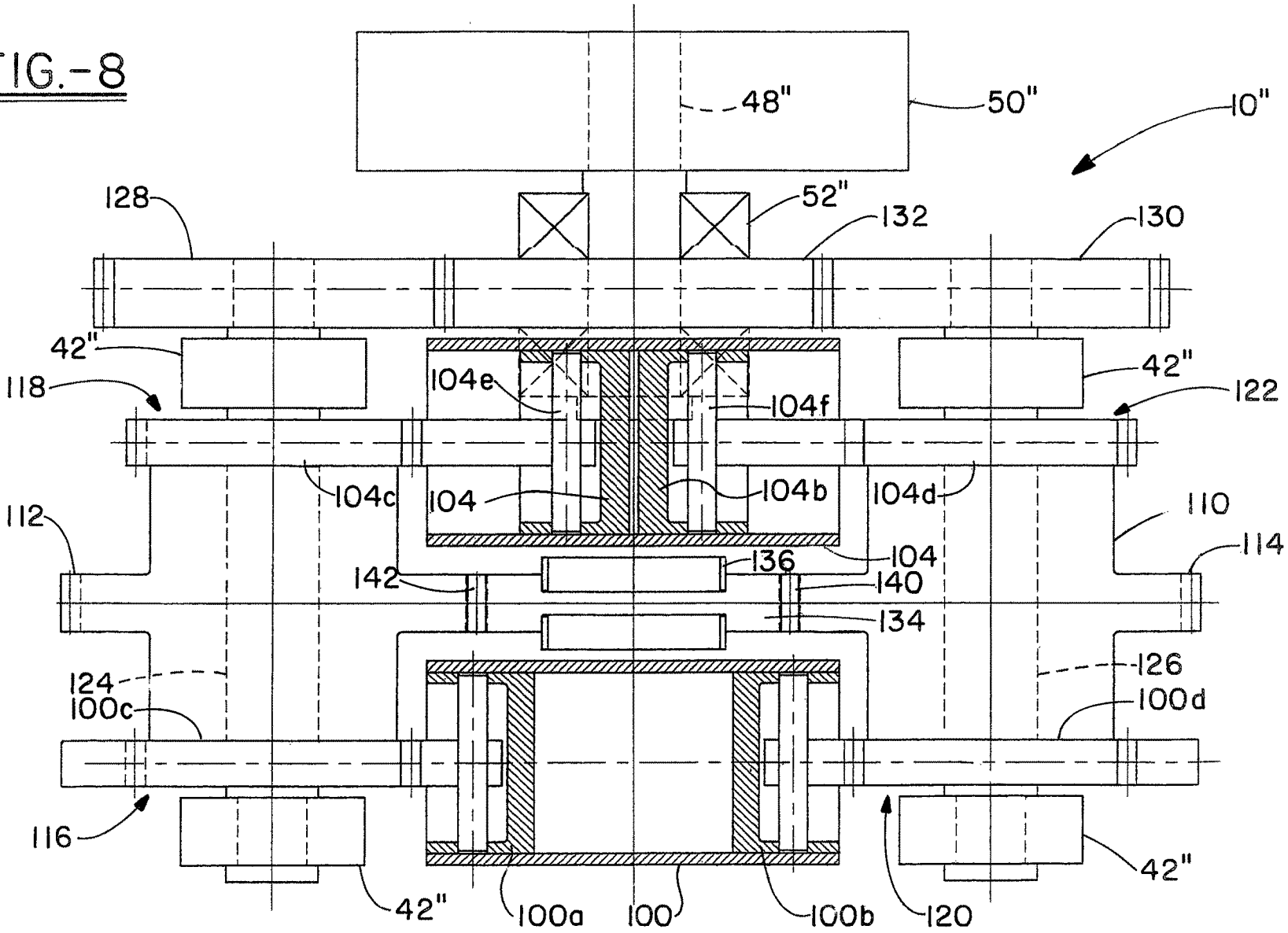
FIG. 8 is a top plan view of an embodiment of the invention employing gear racks and pinion gears for piston power transmission.
Figure 9:
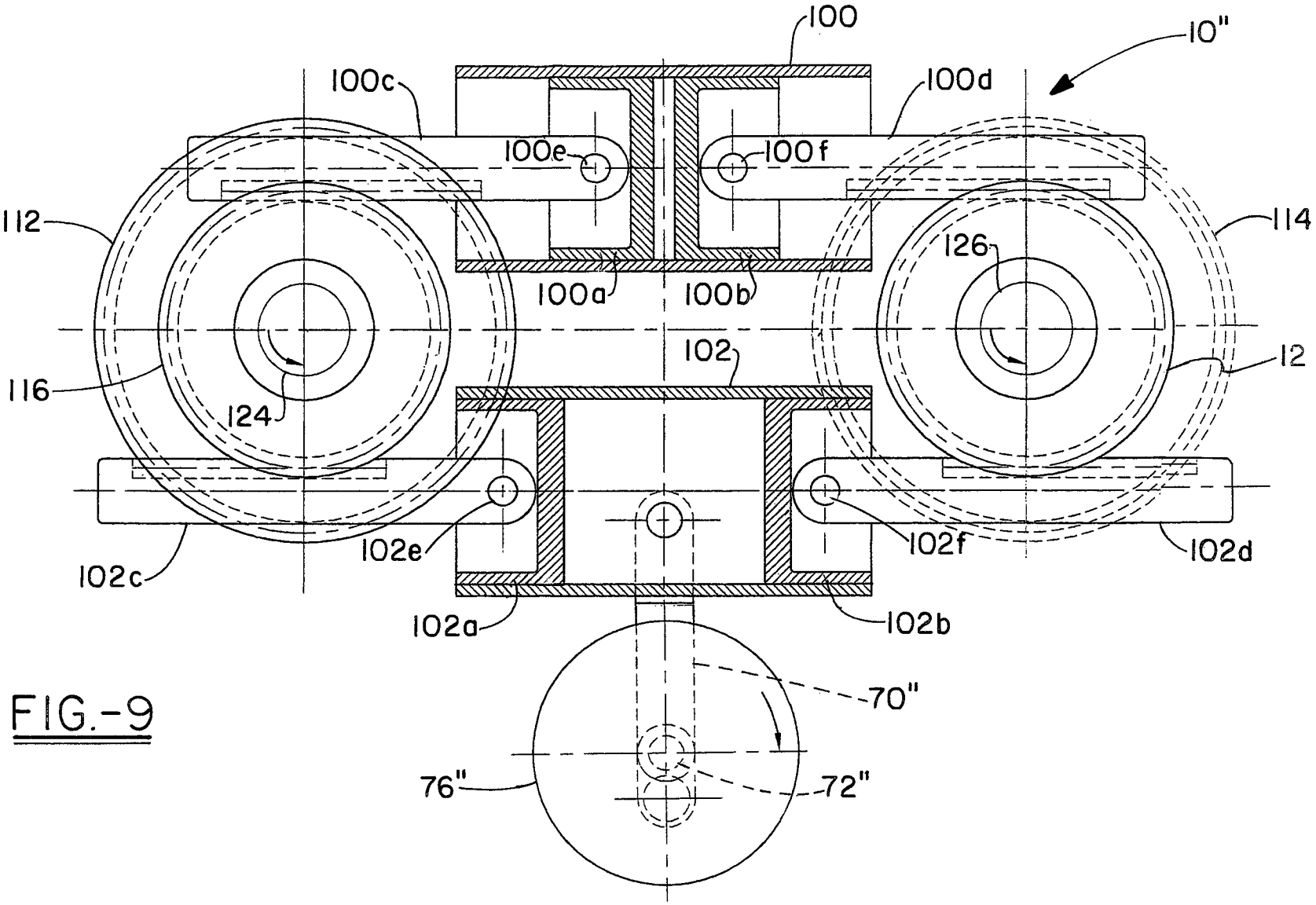
FIG. 9 is a front elevational view of the embodiment of the invention of FIG. 8 taken at a different point in time.
Figure 10:
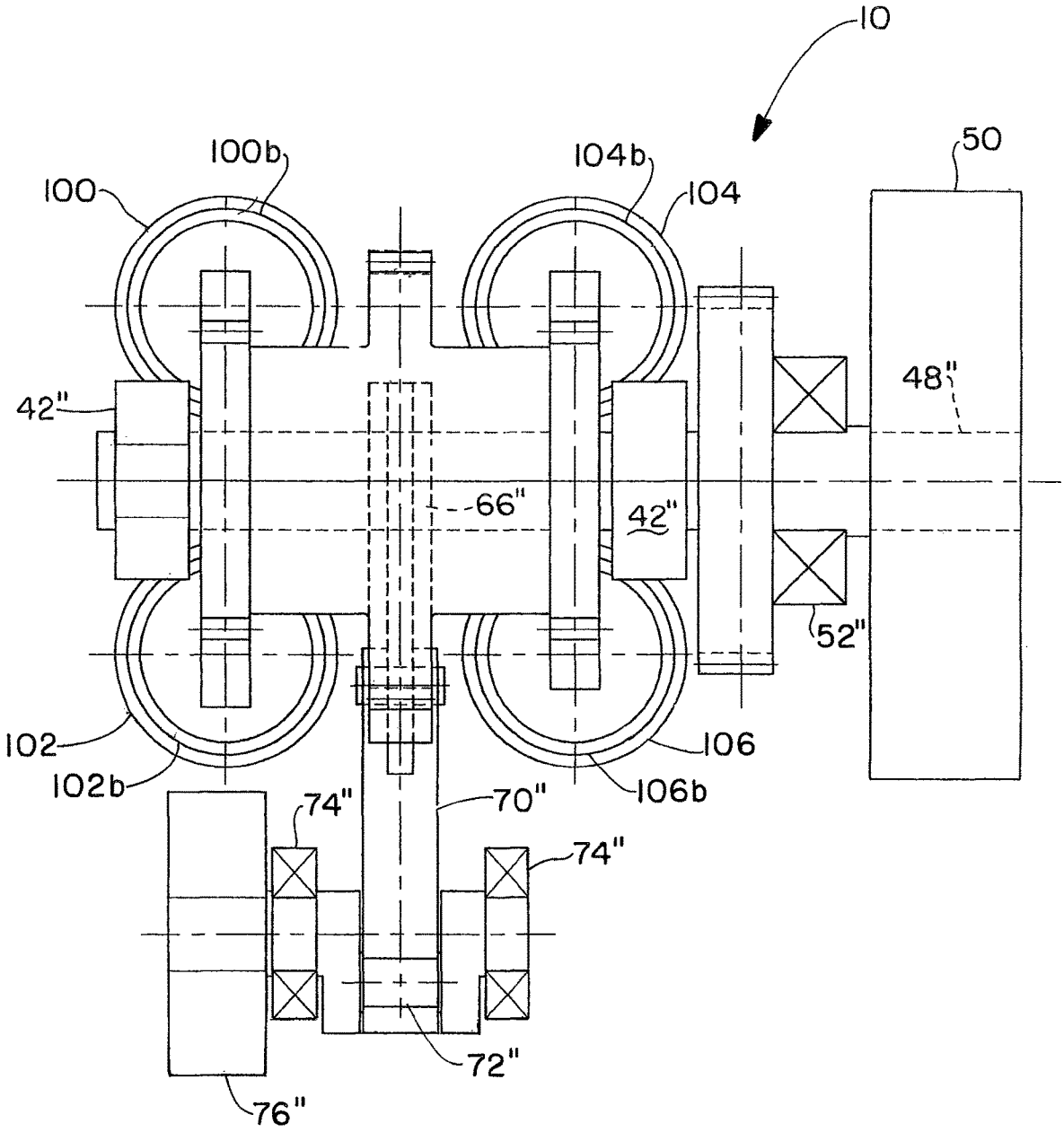
FIG. 10 is a side elevational view of the embodiment of FIGS. 8 and 9.

With reference now to FIGS. 8-10, it can be seen that an internal pressure driven engine made in accordance with another embodiment of the invention is designated generally by the numeral 10". For purposes of facilitating an understanding of this embodiment, where elements of the embodiment of FIGS. 8-10 correspond to elements of the embodiments in FIGS. 1-7, the same numeral designation is employed, with the addition of a double prime (") marker.

As shown in FIGS. 8 and 10, a drive shaft 48" is connected to a flywheel 50", comprising an output for the internal pressure driven engine 10". The drive shaft 48" is mounted through bearings 52" to pinion gears, which will be discussed below.

Also included as part and parcel of the instant invention is a starting mechanism similar to that presented earlier herein. In that regard, a connecting rod 70" connects to a crankshaft 72" which is rotatable through bearings 74", as shown. The crank shaft 72" is connected to an auxiliary flywheel 76", which in turn is connected to a starting motor, driving gear and ring gear, similar to the starting motor 80, driving gear 82 and ring gear 78, not shown here for purposes of simplicity. The connecting rod 70" interconnects with a two-sided gear rack 66" for purposes similar to those presented herein, as will become apparent below.

As shown in FIGS. 8-10, the internal pressure driven engine 10" includes four cylinders 100, 102, 104, 106, each having a pair of opposed pistons 100*a*, 100*b*, 102*a*, 102*b*, 104*a*, 104*b*, 106*a*, 106*b*, received therein. Serving as piston rods and connected to each of the piston heads 100*a*, 100*b*, 106*a*, 106*b* are respective gear racks 100*c*, 100*d*, 102*c*, 102*d*, 104*c*, 104*d*, 106*c*, 106*d*. These piston rod gear racks are respectively connected to piston pins 100*e*, 100*f*, 102*e*, 102*f*, 104*e*, 104*f*, 106*e*, 106*f*, as illustrated.

One way clutches 108, 110 are positioned on opposite sides of the cylinders 100-106. These one way clutches operate in a manner similar to that presented above, being freewheeling in one direction and in driving engagement with respective clutch shafts 124, 126 in the other. Each of the one way clutches 108, 110 has a respective center pinion gear 112, 114 and outboard pinion gears 116, 118 associated with the clutch 108, and outboard pinion gears 120, 122 associated with the clutch 110. The clutch shafts 124, 126, selectively driven by the associated one way clutch assembly 108, 110, are rotatably mounted in bearings 42" and appropriately splined, keyed or otherwise connected to respective output drive gears 128, 130. These output drive gears 128, 130 drive an output driven gear 132 splined or otherwise connected to the drive shaft 48".

It will be appreciated by those skilled in the art that axial movement of the piston heads 100*a*, 100*b*-106*a*, 106*b*, within respective cylinders 100-106, cause the gear racks 100*c*, 100*d*-106*c*, 106*d* to linearly translate, without rotational movement, across respectively associated outboard pinion gears 116-122, transmitting the resultant rotational movement through clutch shafts 124, 126 to pinion output drive gears 128, 130, which in turn drive output driven gear 132, shaft 48" and flywheel 50".

The starter employed for the internal pressure driven engine 10" includes the flywheel 76", crankshaft 72", and two-sided gear rack 134 connected by an appropriate universal joint or the like to the connecting rod 70". The gear rack 134 is interposed between pinion gear 114 of the one way clutch 110 and pinion gear 112 of the one way clutch 108. The gear rack 134 is appropriately mounted on bearings 136, 138. The gear rack 134 drives pinion gears 112 and 114 of the one way clutches 108 and 110. Starting of the engine with an associated starting motor, driving gear and ring gear (not shown) may be achieved in the fashion presented earlier herein.

It will be readily appreciated by those skilled in the art that the linear translation of the piston rod gear racks 100*c*, 100*d*-106*c*, 106*d* and their driving interconnection with uniquely associated pinion gears 116-122 achieves the maintenance of a constant torque arm for the output power of the piston heads as they reciprocate within the associated cylinders. Accordingly, power losses are minimized and efficiency is maximized. Those skilled in the art will readily appreciate that the implementation of a piston rod serving as a gear rack in engagement with a pinion gear on a one way clutch may be substituted for the piston rod and pivot arm interconnection in the embodiment earlier presented herein.

Figure 11:
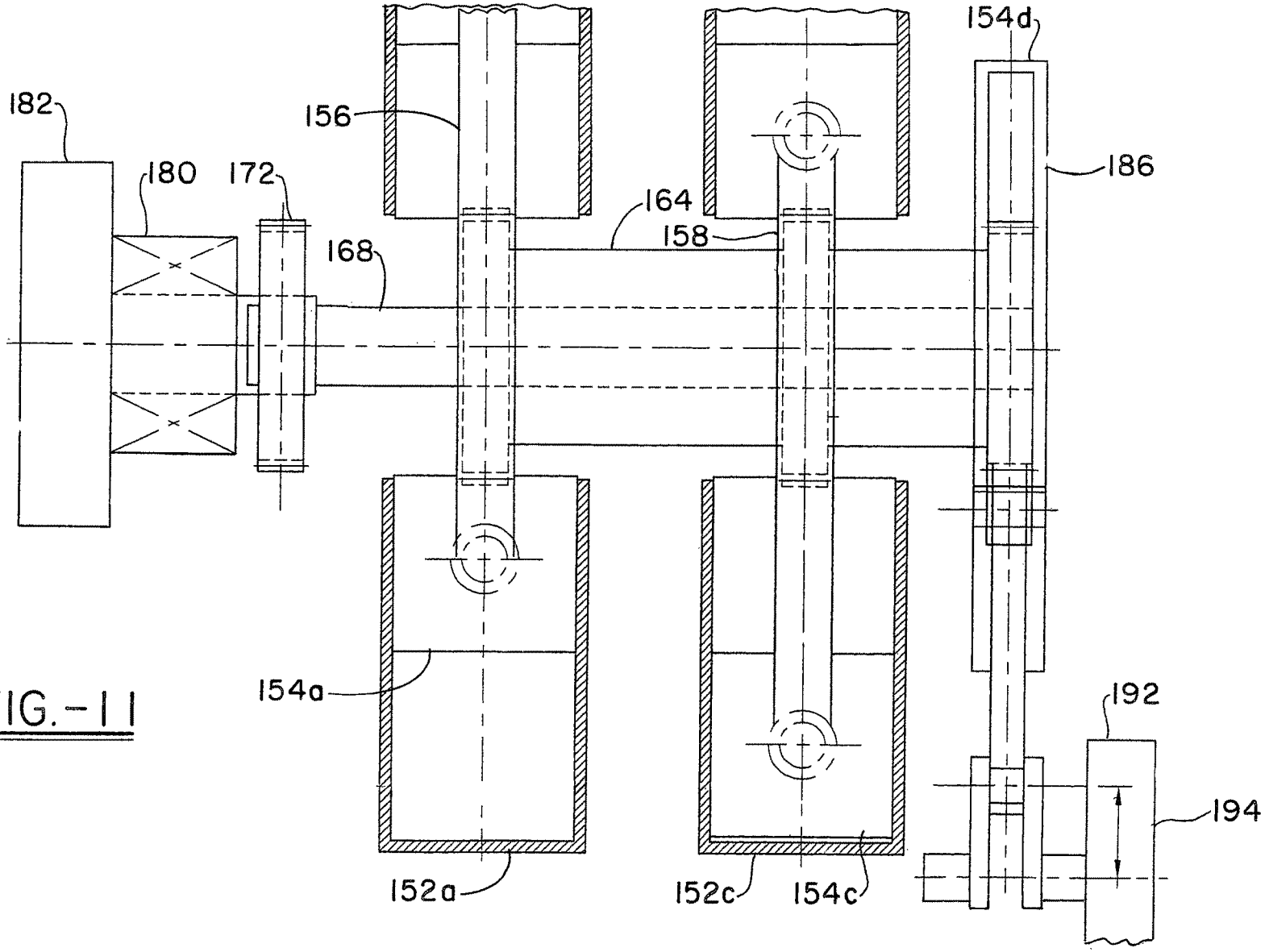
FIG. 11 is a top plan view of another embodiment of the invention wherein the piston rods are gear racks directly driving pinion gears.
Figure 12:
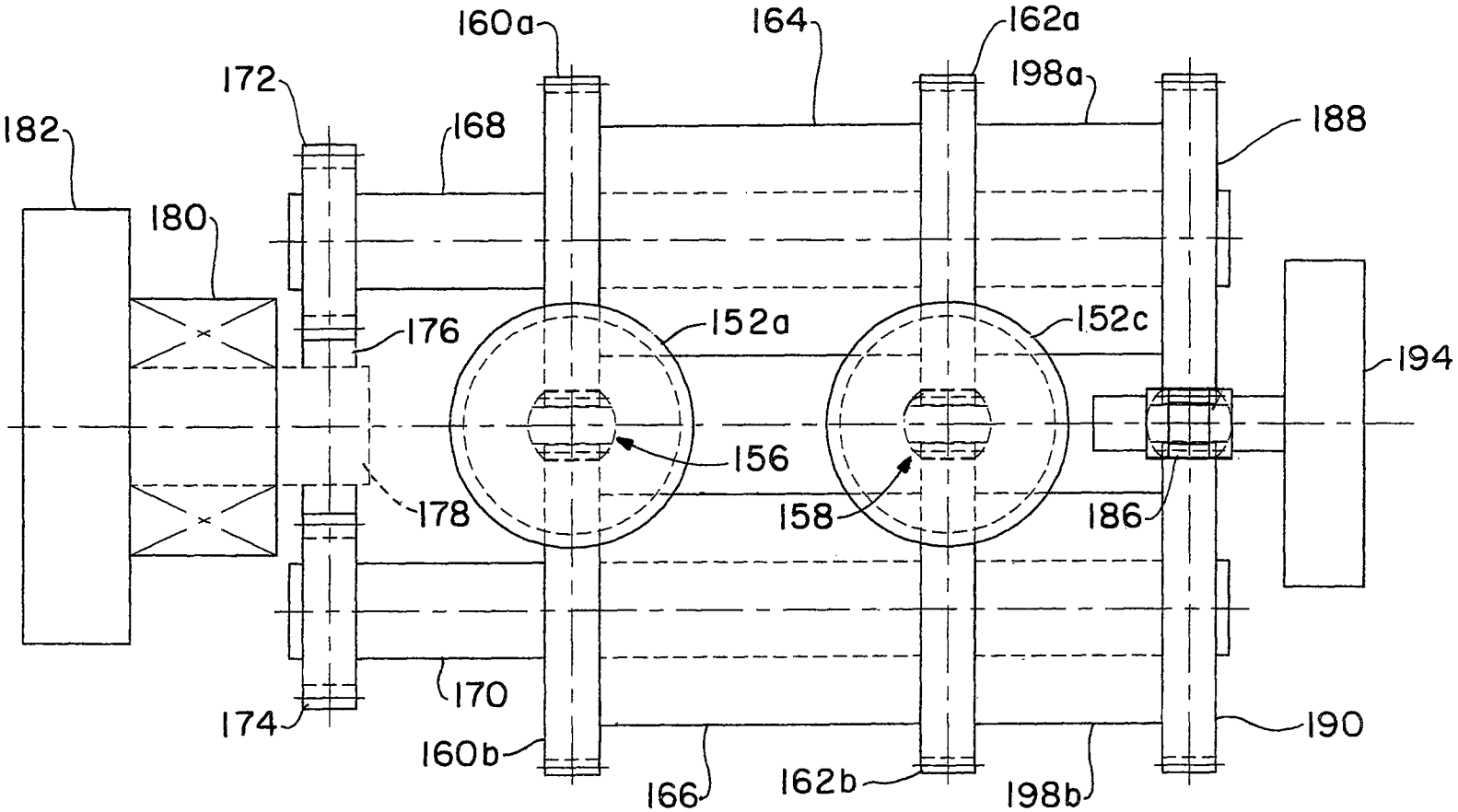
FIG. 12 is a front elevational view of the embodiment of FIG. 11.
Figure 13:
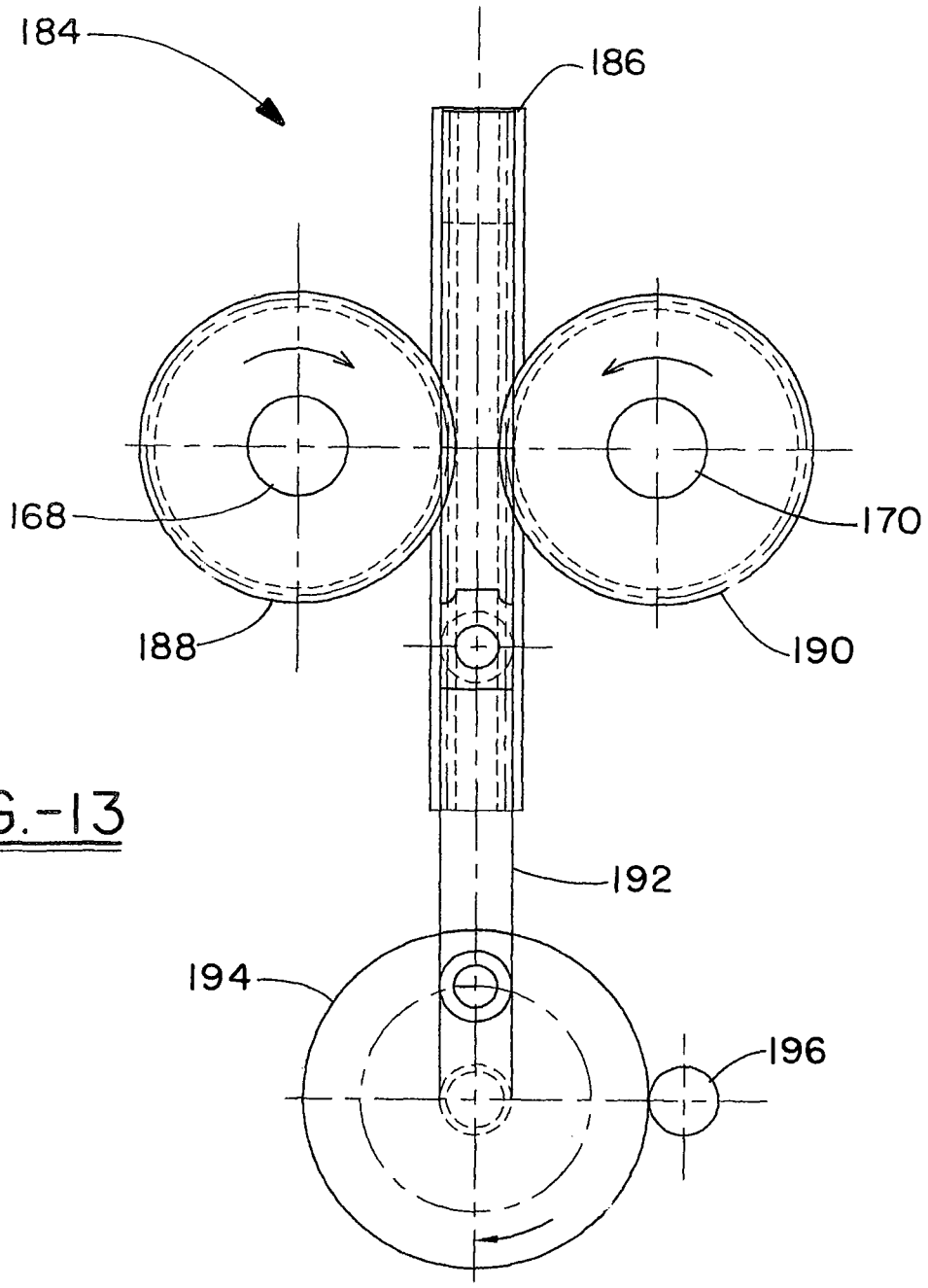
FIG. 13 is a side elevational view of the starter mechanism portion of the embodiment of FIGS. 11 and 12.

Referring now to FIGS. 11-13, an appreciation may be obtained of yet another embodiment of the invention designated generally by the numeral 150. In this embodiment, gear racks serve as piston rods for directly driving pinion gears through associated one way clutches to achieve the desired power output. As shown in an exemplary embodiment, cylinders 152*a*-152*d* respectively receive pistons 154*a*-154*d*, with the pistons 154*a, b* being interconnected by a common piston rod in the form of a gear rack 156, and the pistons 154*c, d* being similarly interconnected by a gear rack 158. The gear rack 156 is in driving engagement with pinion gears 160*a*, 160*b*, while gear rack 158 is in driving communication with pinion gears 162*a*, 162*b*. The pinion gears 160*a*, 162*a* are respectively interconnected through a one way clutch 164 to a drive shaft 168. Similarly, pinion gears 160*b*, 162*b* are interconnected through a one way clutch 166 to a drive shaft 170. Those skilled in the art will appreciate that the one way clutches 164, 166 are respectively oppositely directed, being freewheeling in opposite directions, to effect mutually exclusive output drive to the drive shafts 168, 170.

Pinion gears 172, 174 are respectively mounted on drive shafts 168, 170, with the pinion gears 172, 174 being operative to mutually exclusively and alternately drive the pinion gear 176 mounted upon output shaft 178. The output shaft 178 is supported by bearing 180, and is interconnected with the output flywheel 182.

With an understanding of the structure just described, those skilled in the art will appreciate that as the pistons 154*a-d* reciprocate in associated cylinders 152*a-d*, the associated gear racks 156, 158 cause driving interengagement with pinion gears 160*a, b*, and 162*a, b* which, through associated one way clutches 164, 166 in mutually exclusive operative engagement, drive the pinion gear 176 through respective pinion gears 172, 174 mounted upon drive shafts 168, 170.

With reference now to FIG. 13, in association with FIGS. 11 and 12, an appreciation can be obtained of the starter mechanism 184. Here, a gear rack 186 is in functional engagement with pinion gears 188, 190. As shown, pinion gear 188 is fixed to a spacer or adapter 198*a*, which in turn is fixed to pinion gear 162*a*. Pinion gears 160*a* and 162*a* are fixed to one way clutch 164. Accordingly, pinion gears 160*a*, 162*a*, 188 rotate together. Similarly, pinion gear 190 is fixed to a spacer or adapter 198*b*, which in turn is fixed to pinion gear 162*b*. Pinion gears 160*b*, 162*b* are fixed to one way clutch 166. Accordingly, pinion gears 160*b*, 162*b*, 190 rotate together. A connecting rod 192 interconnects the gear rack 186 with a flywheel 194, which is in selective operative engagement with a starter motor 196. Those skilled in the art will appreciate that as with the mechanism of FIG. 4, actuation of the starter motor 196 causes rotation of the flywheel 194, which, through the connecting rod mechanism 192, causes reciprocation of the gear rack 186 which, through pinion gears 188, 190 causes reciprocation of the pistons 154*a*-154*d* within associated cylinders 152*a*-152*d* through the interengagement of gear racks 156, 158 with pinion gears 160, 162. Of course, once the engine 150 has started, disengagement of the starter 196 is effected, and operation of the engine continues as it cycles with kinetic energy stored in the flywheel 194.

Many variations of the gears and cylinder arrangements can be used without departing from the scope of the invention so long as the combination of two opposed pistons in each cylinder are connected through on/off clutches and through a gear rack assembly to provide continuous rotation of a main output shaft.

It should also be understood that the overall principle of this engine can be applied to gasoline engines, diesel engines, steam engines or engines using other types of fuel or fluid pressure injected into the cylinders. In cases of steam engines the opposed pistons are caused to move by steam pressure between the pistons rather that combustion of the fuel.

What is claimed is:

1. An internal combustion engine of the type capable of converting reciprocal linear powered motion into unidirectional rotary motion for acting on an output drive, comprising:

at least one pair of cylinders, each cylinder having an annular interior cylinder wall;

a pair of opposed pistons within each cylinder, each piston having an inwardly facing end and an outwardly facing end, said pistons and said cylinder wall forming a combustion chamber between inwardly facing ends of said pistons;

a piston rod attached to the outer end of each piston and extending axially outwardly from the outer end of the cylinder;

creating combustion within said combustion chamber to cause both pistons to move axially in a reciprocating movement to and from each other;

a one-way clutch in operative engagement with each outwardly extending piston rod to convert said axial reciprocal movement of said piston rod to unidirectional rotary movement and further effects arcs of operation of said pivot arms through step-by-step intermittent engagements of said one way clutch; and an output drive shaft operatively connected to said one-way clutch.

2. The internal combustion engine as claimed in claim 1, wherein said one-way clutch engages when the piston rod is traveling in one direction and releases when the piston rod is traveling in the opposite direction.

3. The internal combustion engine as claimed in claim 2, further comprising an assembly of a crank shaft and flywheel operatively connected to each pinion gear through a longitudinally reciprocating gear rack, the assembly controlling the engine, and creating a double torque arm.

4. The internal combustion engine as claimed in claim 3, wherein an electric starter is operatively connected to the flywheel to cause starting rotation of the flywheel to start the engine.

5. The internal combustion engine as claimed in claim 2, further comprising a gear rack integrally formed with said piston rod and operatively engaging a pinion gear operatively connected to said one way clutch.

6. The internal combustion engine as claimed in claim 1, having a plurality of pairs of cylinders with each cylinder having a pair of opposed pistons.

7. The internal combustion engine as claimed in claim 6, wherein the pistons move axially in a reciprocating manner with part of the pairs of pistons moving axially outwardly as other pairs of pistons are simultaneously moving axially inwardly.

8. An internal combustion engine of the type capable of converting reciprocal linear powered motion into unidirectional rotary motion for acting on an output drive, comprising:

an engine bock having a plurality of pairs of cylinders, each cylinder having an annular interior cylinder wall;

a pair of opposed pistons within each cylinder, each piston having an inwardly facing end and an outwardly facing end;

said pistons and said cylinder wall forming a combustion chamber between inwardly facing ends of said pistons;

a piston rod attached to an outer end of each piston and extending axially outwardly from the outer end of the cylinder;

creating combustion within said combustion chamber to cause both pistons to move axially in a reciprocating movement to and from each other;

a one-way clutch in operative engagement with each outwardly extending piston rod to convert the axial reciprocal movement of the piston rod to unidirectional rotary movement and further effects arcs of operation of said pivot arms through step-by-step intermittent engagements of said one way clutch; and an output drive shaft operatively connected to said one-way clutch.

9. The internal combustion engine as claimed in claim 8, wherein said one way clutch attached to each pivot arm engages when said pivot arm is traveling in one direction and releases when said pivot arm is traveling in the opposite direction.

10. The internal combustion engine as claimed in claim 9, further comprising an assembly of a crank shaft and flywheel operatively connected to each pinion gear through a longitudinally reciprocating rack gear, said assembly controlling the engine and creating a double torque arm.

11. The internal combustion engine as claimed in claim 8, wherein an electric starter is operatively connected to said flywheel to cause starting rotation of the flywheel to start the engine.

12. The internal combustion engine as claimed in claim 8, wherein said pistons move axially in a reciprocating manner with part of said pairs of pistons moving axially outwardly as other pairs of pistons are simultaneously moving axially inwardly.

13. The internal combustion engine as claimed in claim 9, further comprising a gear rack integrally formed with said piston rod and operatively engaging a pinion gear operatively connected to said one way clutch.

14. An internal combustion engine of the type capable of converting reciprocal linear powered motion into unidirectional rotary motion for acting on an output drive, comprising:

an engine block having at least one pair of first and second cylinders with each cylinder having an annular interior cylinder wall;

a pair of opposed pistons within each cylinder, each piston having an inwardly facing end and an outwardly facing end;

said pistons and said cylinder wall forming a combustion chamber between inwardly facing ends of said pistons;

creating combustion within the combustion chamber to cause both pistons to move axially in a reciprocating movement to and from each other;

a piston rod pivotally attached to the outer end of each piston and extending axially outwardly from the outer end of the cylinder;

each piston rod having an outer end pivotally connected to a pivot arm on a respective one way clutch to cause reciprocal rotation of the one way clutch with the clutch and pivot arm reversing direction of rotation with each outward and inward stroke of said piston;

each first and second cylinder of said pair being parallel to each other and spaced apart a sufficient distance from each other so that the end of a piston rod extending from one end of said first cylinder is pivotally connected to a first pivot arm on an adjacent first one way clutch and the end of the piston rod extending from an adjacent end of said second cylinder is pivotally connected to a second pivot arm on the adjacent first one way clutch with one of said piston rods moving in an outward stroke while the other is moving in an inward stroke;

said piston rods extending from opposite ends of the first and second cylinders being pivotally connected to pivot arms on a second one way clutch to cause it to simultaneously rotate n a direction opposite to said first one way clutch; and both said first and second pivot arm each connected through a clutch mechanism to an output shaft and drive gear with said clutch effecting arcs of operation of said pivot arms and alternating in step-by-step fashion between engage and disengage positions to convert the reciprocating movement of said first and second pivot arms to continuous unidirectional rotation.

15. The internal combustion engine as claimed in claim 14, further comprising first and second pinion gears respectively moved by said first and second one way clutch and a longitudinally reciprocating gear rack lying between said first and second pinion gears and having teeth engaging both said first and second pinion gears, said longitudinally reciprocating gear rack operatively connected to a crankshaft and flywheel mechanism to provide additional rotational force to assure continual reciprocating movement of said first and second pinion gears, said first and second clutch and their respective pivot arms and of said piston rods connected thereto.

16. The internal combustion engine as claimed in claim 15, wherein an electric starter is operatively connected to said flywheel to cause starting rotation of the flywheel to start the engine.

17. The internal combustion engine of claim 15, further comprising a first intermediate pinion gear between said first pinion gear and said longitudinally reciprocating gear rack and a second intermediate pinion gear between said second pinion gear and said longitudinally reciprocating gear rack.

18. An internal pressure driven engine of the type capable of converting reciprocal linear powered motion into unidirectional rotary motion for acting on an output drive, comprising:

an engine block having at least one pair of first and second cylinders with each cylinder having an annular interior cylinder wall;

a pair of opposed pistons within each cylinder, each piston having an inwardly facing end and an outwardly facing end;

said pistons and said cylinder wall forming a pressure chamber between inwardly facing ends of said pistons;

creating pressure within said chamber to cause both pistons to move axially in a reciprocating movement to and from each other;

a piston rod pivotally attached to the outer end of each piston and extending axially outwardly from the outer end of the cylinder;

each piston rod having an outer end pivotally connected to a pivot arm on a respective one way clutch to cause reciprocal rotation of said one way clutch with said clutch and pivot arm reversing direction of rotation with each outward and inward stroke of said piston;

each first and second cylinder of the pair being parallel to each other and spaced apart a sufficient distance from each other so that the end of a piston rod extending from one end of the first piston is pivotally connected to a first pivot arm on an adjacent first one way clutch and the end of the piston rod extending from an adjacent end of said second piston is pivotally connected to a second pivot arm on said adjacent first one way clutch with one of said piston rods moving in an outward stroke while the other is moving in an inward stroke;

said piston rods extending from opposite ends of said first and second pistons being pivotally connected to pivot arms on a second one way clutch to cause it to simultaneously rotate in a direction opposite to said first one way clutch; and both said first and second pivot arms each connected through a clutch mechanism to an output shaft and drive gear with said clutch effecting arcs of operation of said pivot arms and alternating in step-by-step fashion between engage and disengage positions to convert the reciprocating movement of the first and second pivot arms to continuous unidirectional rotation.

19. The internal pressure driven engine as claimed in claim 18, wherein said motion conversion means comprises an assembly of a crank shaft and flywheel operatively connected to each pinion gear through a longitudinally reciprocating gear rack, said assembly controlling the engine and creating a double torque arm.

20. The internal pressure driven engine as claimed in claim 19, wherein a starter is operatively connected to said flywheel to cause starting rotation of said flywheel to start the engine.

* * * * *